US005111544A

United States Patent [19]

Graebe

[11] Patent Number: 5,111,544

[45] Date of Patent: May 12, 1992

[54] COVER WITH ELASTIC TOP AND FRICTIONAL BOTTOM FOR A CUSHION

[76] Inventor: Robert H. Graebe, 7 Persimmon Ridge Dr., Belleville, Ill. 62221

[21] Appl. No.: 723,408

[22] Filed: Jul. 1, 1991

[51] Int. Cl.[5] ..... A47G 9/00; A47C 31/00

[52] U.S. Cl. ..... 5/470; 5/490; 5/485

[58] Field of Search ..... 5/470, 490, 420, 449, 5/450, 455, 485, 448

[56] References Cited

U.S. PATENT DOCUMENTS 4,147,828 4/1979 Heckel et al. ..... 5/420
4,164,798 8/1979 Weber ..... 5/464
4,541,136 9/1985 Graebe ..... 5/456
4,682,818 7/1987 Morell ..... 5/464
4,914,772 4/1990 Difloe ..... 5/461

OTHER PUBLICATIONS

"Roho" Owner's Manual, Available from Roho, Inc., 1000 Florida Ave., Belleville, Ill., 62221.

*Primary Examiner*—Alexander Grosz
*Attorney, Agent, or Firm*—Gravely, Lieder & Woodruff

[57] ABSTRACT

A cover, which fits over a cushion, has a top panel formed from a highly elastic fabric and bottom panel formed from a high friction mesh. The top panel easily conforms to the shape of the user's buttocks with exerting shear on the skin. The bottom panel stabilizes the cushion on a supporting surface by reason of substantial friction between it and the supporting surface.

14 Claims, 2 Drawing Sheets

FIG. 1.
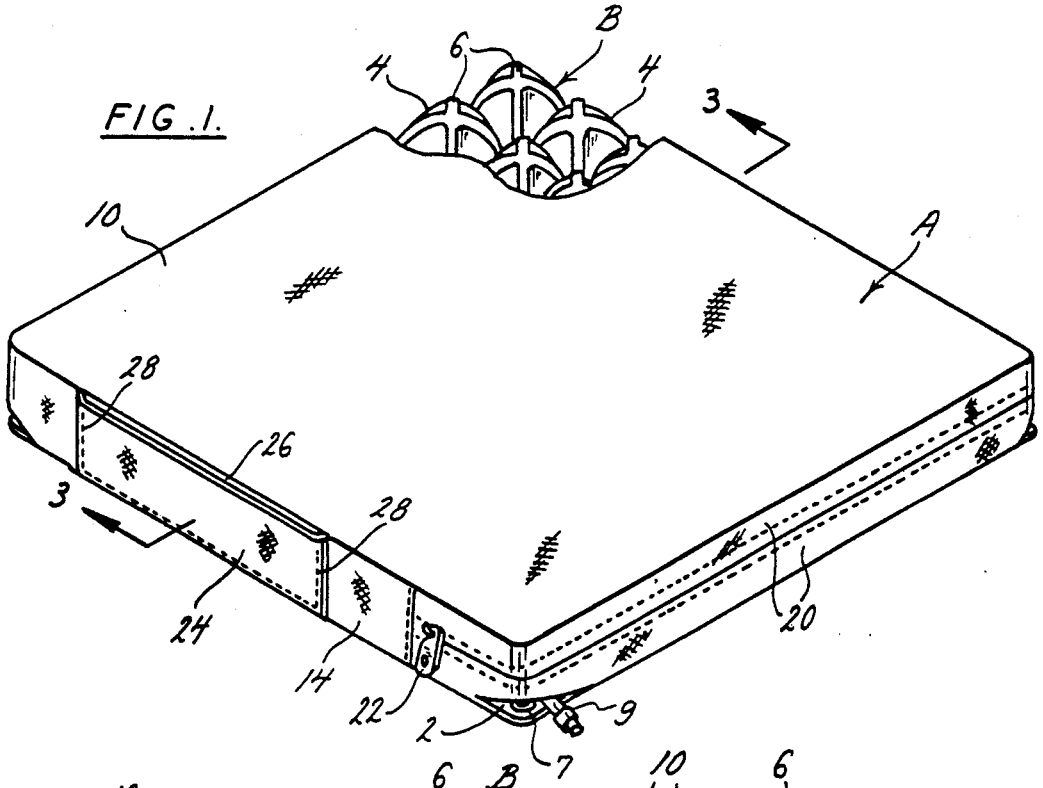
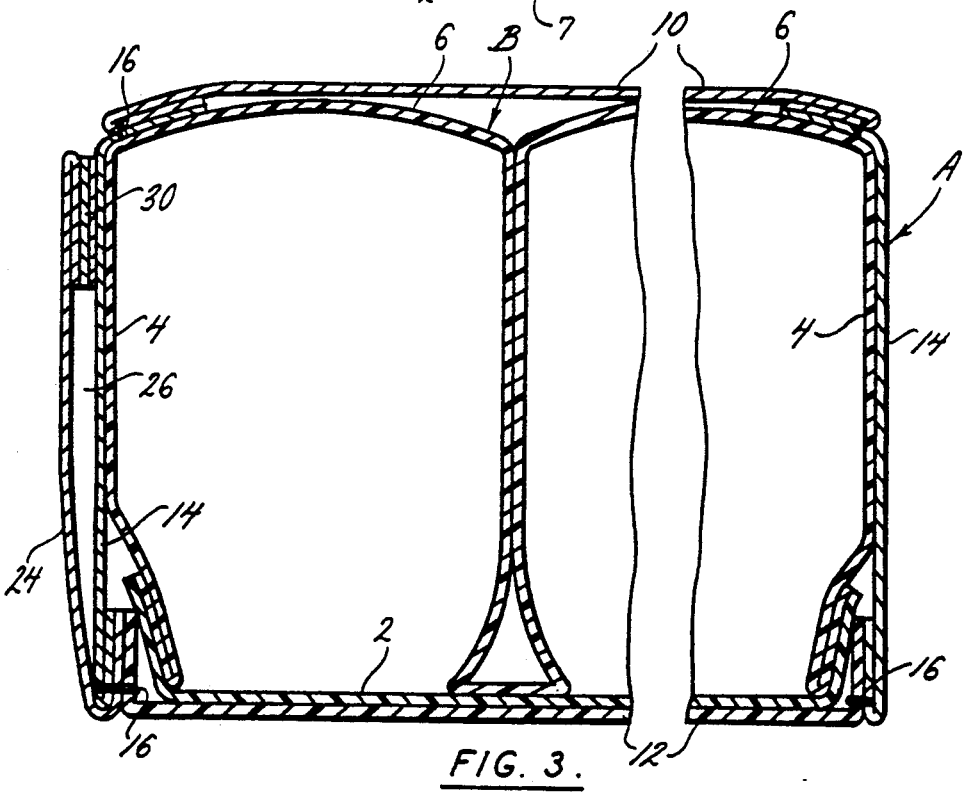
FIG. 3.

FIG. 2.
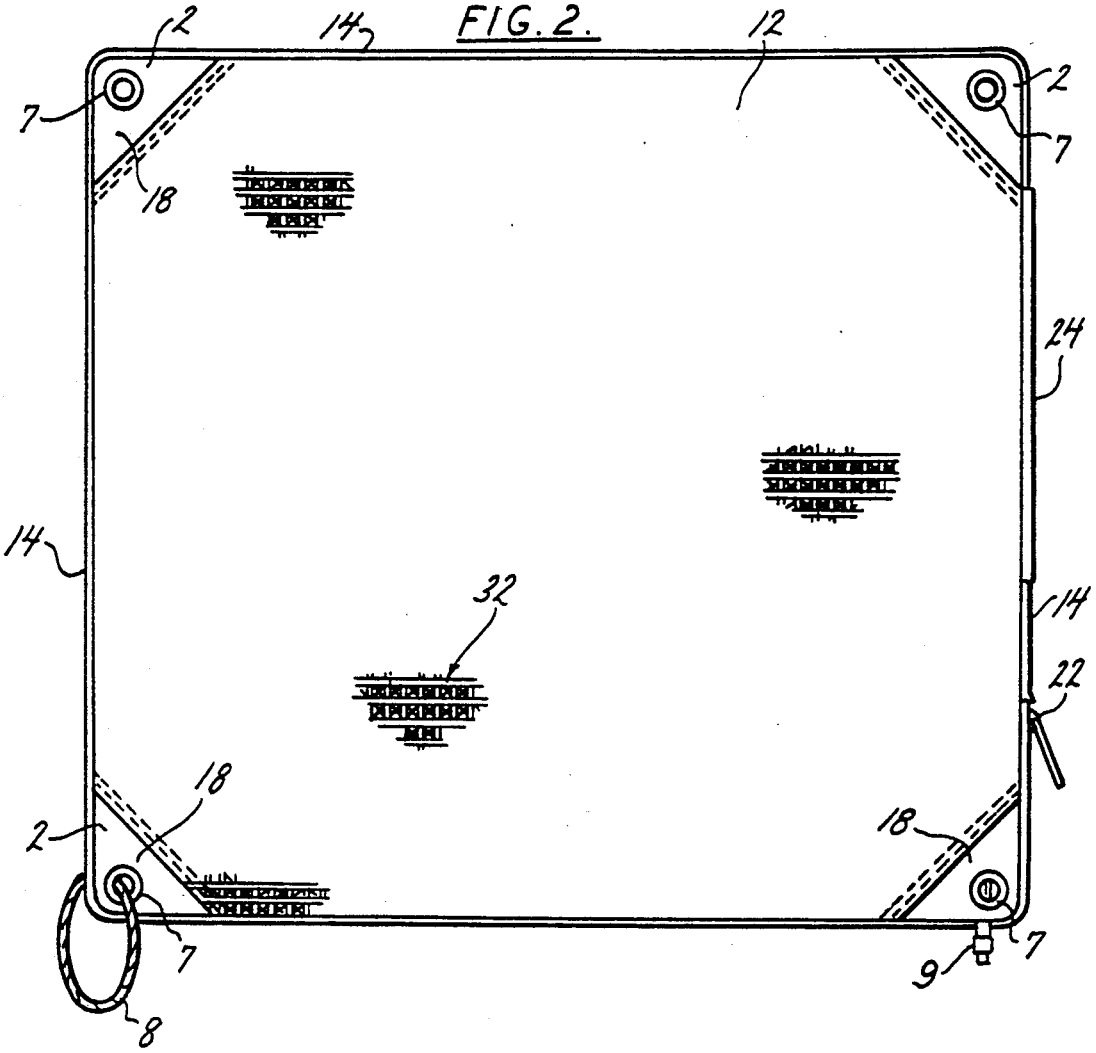
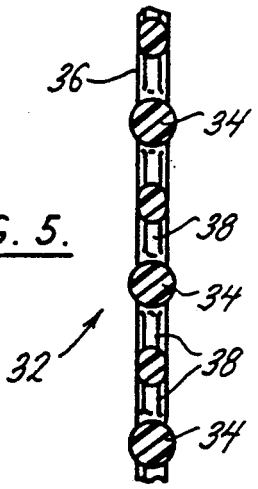
FIG. 5.
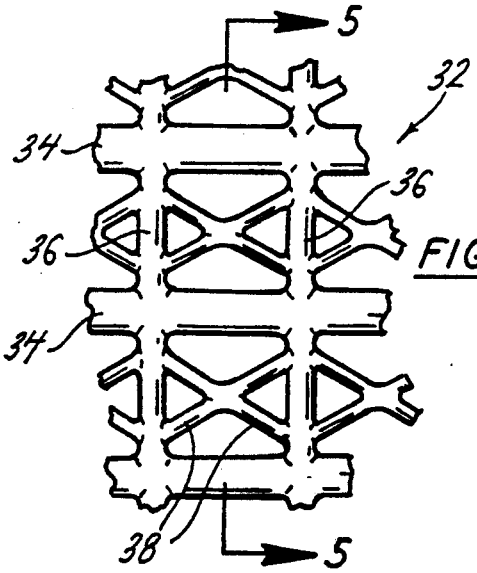
FIG. 4.

COVER WITH ELASTIC TOP AND FRICTIONAL BOTTOM FOR A CUSHION

BACKGROUND OF THE INVENTION

This invention relates in general to cushions for seating and more particularly to a novel cover for such cushions and to a cushion fitted with such a cover.

Those who must spend extended time in wheelchairs run the risk of developing decubitus ulcers, more commonly known as pressure sores. The lack of activity or movement diminishes the flow of blood to skin in the region of the buttocks, particularly to the skin covering the boney prominences of the buttocks, and as a consequence the tissue in this region tends to break down. To reduce the incidence of pressure sores, special cushions exist that generally distribute the user's weight more uniformly over the buttocks, so that it does not concentrate at the boney prominences.

One wheelchair cushion which is extremely effective in preventing pressure sores relies on a series of interconnected air cells, the ends of which provide a seating surface for supporting the user. Being interconnected, all of the cells exist at the same internal pressure, and this, coupled with the high flexibility of the cells, enables the cells to conform to the shape of the user's buttocks and thus distribute the user's weight over a much larger area of the buttocks. When one sits upon a cellular cushion, the peripheral cells tend to deflect outwardly and may become caught in the frame of the wheelchair or even in the spokes of the wheels, perhaps puncturing some of the cells. Covers exist for reducing this possibility, but covers of current manufacture are usually formed from fabric which is quite slick and tends to slide easily over the underlying supporting surface. Thus, the cushion may be easily displaced from its proper supporting position. This holds true with regard to covers for other types of cushions as well. Aside from that, traditional cushion covers do not facilitate drainage or the circulation of air around and within the cushion.

The present invention resides in a cover for a cushion, and that cover has a bottom panel formed from material having a high friction mesh to prevent the cover and the cushion encased in it from sliding over smooth supporting surfaces. Being a mesh, the material has openings to facilitate drainage and enhance air circulation.

DESCRIPTION OF THE DRAWINGS

In the accompanying drawings which form part of the specification and wherein like numerals and letters refer to like parts wherever they occur:

FIG. 1 is a perspective view of a cover constructed in accordance with and embodying the present invention, with the cover being partially broken away to expose a cellular cushion over which it is fitted;

FIG. 2 is a bottom plan view of the cover showing its bottom panel which is formed from a high friction mesh;

FIG. 3 is a sectional view of the cover and cushions taken along line 3—3 of FIG. 1;

FIG. 4 is an enlarged view of the bottom panel showing the mesh; and

FIG. 5 is a sectional view of the bottom panel taken along line 5—5 of FIG. 4.

DETAILED DESCRIPTION

Referring now to the drawings, a cover A (FIG. 1) fits over and encases a cushion B to protect the cushion B and to further impart greater stability to it. The cushion B may be a cellular cushion of the type manufactured by Roho, Inc., of Belleville, Ill. U.S. Pat. No. 4,541,136 discloses a cellular cushion.

The typical cellular cushion B has a flexible base 2 of rectangular shape and air cells 4 projecting upwardly from the base 2. The interiors of the air cells 4 communicate through passages within the base 2 and thus all of the air cells 4 exist at the same internal pressure. The cells 4 lie close together in rows, and when the cells 4 are inflated, the sides of adjacent cells 4 actually contact each other (FIG. 3). The cells 4 have domed-shaped upper ends 6, and these ends establish a generally continuous seating surface which lies above the base 2, conforming well to generally about any shape that is brought against it, but particularly to the shape of the human buttocks. This capacity to conform to the shape of buttocks and the intercommunication of the cells 4 enables the weight of the user to be distributed over a larger skin area of the buttocks, and this reduces the incidence of pressure sores. At each of its corners the base 2 is fitted with a grommet 7, one or more of which may have a short loop 8 of rope extended through it to facilitate carrying and otherwise handling the cushion B. At one of the corners of the base 2, the cell 4 at that corner has a valve stem 9 which projects laterally from it near the base 2. The cells 4 are inflated or deflated through the valve stem 9.

The cover A fits over the seating surface formed by the dome-shaped ends 6 of the cells 4, and also along the sides of the peripheral cells 4 and under the base 2, generally encapsulating the cushion B. Yet, it does not impair the effectiveness of the cushion B, for the ends 6 of the cells 4 are easily displaced toward the base 2 to conform to the shape of the user's buttocks. Moreover, the cover A is easily stripped from the cushion B to enable the two to be cleaned separately.

The cover A includes (FIGS. 1-3) a top panel 10, a bottom panel 12 and four side panels 14 which extend between and are joined to the top and bottom panels 10 and 12 along stitch lines 16. Both the top and bottom panels 10 and 12 are rectangular in shape, and that shape matches the shape of the base 2 for the cushion B. The side panels 14 are of equal height, and that height generally corresponds to the height of the cells 4 when they are fully extended. The stitch line 16 connecting the upper panel 10 to the side panel 14 extends along the full periphery of the cover A and is continuous in the sense that no interruptions exist in the seam that it forms. On the other hand, stitch line 16 between the bottom panel 12 and the side panel leaves a gap 18 (FIG. 2) at each of the four corners. The gaps 18 are large enough to accommodate the corners of the base 2 to the extent of exposing the grommets 7 in those corners and further will accommodate the flexible loop 8 and the valve stem 9, and thus allow them to project beyond the cover A, all when the cover A is fitted over the cushion B. One of the side panels 14 is severed into two sections 20 for its full length as are short segments in the two adjacent panels 14, so that the sections 20, which are continuous, occupy the whole of one panel 14 and parts of the two adjacent panels 14. The sections 20 carry a zipper 22 which normally joins them together as one. One of the adjacent side panels 14 has attached to it a somewhat shorter panel 24 which creates a pocket 26 along that side panel 14 (FIGS. 1 and 3). In this regard, the lower margin of the short panel 24 is caught in the stitch line 16 that attaches the bottom and side panels 12 and 14, whereas the sides of the short panel 24 are connected to the underlying side panel 14 by more stitch lines 28. The upper margin of the short panel 24 is further attached to the underlying side panel 14 with a detachable fastener 30 such as Velcro fastening material.

The top panel 10 is formed from a highly elastic fabric—one that stretches in any direction. The elasticity of the top panel 10 enables that panel to conform to the shape of the user's buttocks when the user sits upon the cushion B. The top panel 10 simply follows the contour of the seating surface created by the dome-shaped upper ends 6 of cells 4 and imposes minimum shear on the user's skin. It detracts little from the capacity of the array of air cells 4 to conform to the shape of the user's buttocks.

The bottom panel 12, on the other hand, is formed from a high friction mesh 32 (FIGS. 4 & 5) known as vinyl coated scrim. The mesh 32 consists of polyester fibers woven into an open weave and a polyvinyl chloride coating covering the polyester fibers without obliterating the openings of the weave. The weave is such that the mesh 32 has relatively thick ribs 34 extending parallel between opposite edges of the panel 12 and thinner connecting segments 36 extending between the ribs 34 and oriented at right angles with respect to the ribs 34, with the spacing between the connecting segments 36 being about the same as the spacing between the ribs 34. This forms a pattern of square openings, which are divided by diagonal segments 38 that extend between the connecting segments 36, and cross at the centers of the square openings. The coating has a high coefficient of friction against traditional seating surfaces such as wood, metal or fabric, and the friction that develops is particularly effective along the thick ribs 34. The coefficient of friction between the coating and such surfaces is substantially greater than the coefficients of friction between the top or side panels 10 and 14 and such surfaces. The mesh 32 is commonly used as an underlayment for throw rugs to prevent them from slipping on traditional flooring materials such as tile, vinyl and hardwood. It may be obtained from Vantage Industries, Inc., of Atlanta, Ga. The high friction mesh 32 of the bottom panel 12 prevents the cover A and cushion B over which it fits, from sliding over a supporting surface such as the seat of a wheel chair or the seat of a traditional chair or bench. In addition, it admits air to interior of the cover A where the air can circulate through the array of air cells 4. Finally, it permits moisture to drain from the interior of the cover A.

The side panels 14 are formed from a more traditional fabric—one that has considerable flexibility, yet does not stretch easily. Typical nylon fabric is suited for this purpose. Indeed, three of the panels 14 may be formed almost entirely from a single strip of this fabric without any cuts or seams except where the strip is connected to the sections 20 that form a small segment of two of the panels 14 and a whole of the fourth panel 14.

The cover A is fitted to the cushion B, preferably when the cushion B is deflated, simply by opening the zipper 22, spreading the two sections 20 of the split side panels 14, and pulling the cover A over the cushion B, all such that the base 2 of the cushion B lies along the bottom panel 12, while the dome-shaped ends 6 of the cells 4 lie along the elastic top panel 10. The peripheral cells 4 lie along and are confined by the side panel 14. The corners of the base 2 will emerge from the gaps 18 at the corners of cover A to thereby expose the grommets 7. The flexible loop 8 and valve stem 9 are manipulated through the gaps 18 at the corners where they are located. Once the cushion B is fitted properly into the interior of the cover A, the zipper 22 is closed, thus fully encapsulating the cushion B within the cover A. The cells 4 of the cushion B are then inflated through the valve stem 8.

In use, the cushion B, with the cover A fitted to it, is placed on a supporting surface, such as the seat of a wheelchair or a seat of a traditional chair or bench, with the bottom panel 12 presented downwardly against the supporting surface. The user then sits upon the cushion B and sinks into the array of air cells 4 which are displaced so that the seating surface formed by the upper ends 6 of the cells 4 generally conforms to the shape of the user's buttocks. Since all of the cells 4 exist at the same internal pressure, the user tends to float on the array of cells 4, and the user's weight is distributed generally uniformly over the entire skin area in contact with the cushion B or more accurately in contact with the top panel 10 of the cover A. In this regard, the top panel 10 simply stretches to accommodate the contours of the buttocks and, by reason of the high measure of elasticity, imposes little shear or stretch on the contacting skin area.

The high coefficient of friction that exists between the bottom panel 12 and the underlying supporting surface, coupled with the concentration of the user's weight on that panel 12 stabilizes the cover A and the encased cushion B on the supporting surface, so that it is difficult to displace. Indeed, it is practically impossible to slide the combination cover A and cushion B over a traditional wood seating surface without lifting the combination slightly. The bottom panel 12 is rendered particularly effective by reason of the mesh 32 and the thicker ribs 34 within that mesh 32, for it is along the ribs 34 that most of the friction develops with a supporting surface.

The open mesh 32 of the bottom panel 12 will allow air to enter the interior of the cover A and circulate around the cells 4 of the cushion B. It also permits moisture to drain from the cover A.

The cover A may be used over more traditional cushions, such as those formed from resilient foams.

This invention is intended to cover all changes and modifications of the example of the invention herein chosen for purposes of the disclosure which do not constitute departures from the spirit and scope of the invention.

What is claimed is:

1. In combination with a cellular cushion having a rectangular base and air cells projecting upwardly from the base to form an array of air cells in which the upper ends of the cells form a seating surface that will conform to the shape of a user's buttocks, a cover fitted over the cushion and comprising:

(a) a top panel located over the upper ends of the cells and being formed from a highly elastic fabric;

(b) a bottom panel located under the rectangular base and covering substantially the entire base, said bottom panel being formed from a high friction mesh, said mesh being flexible and having parallel ribs and thinner connecting segments extended between the ribs;

(c) side panels located between and connected to the top and bottom panels at the peripheral margins of the top and bottom panels, said side panels being formed from a highly flexible but substantially non-elastic fabric, one of the side panels being divided into sections which are normally joined, but may be detached to permit the cover to be removed from or fitted over the cushion; and (d) the coefficient of friction between the mesh of the bottom panel and traditional cusion-supporting surfaces being substantially greater than the coefficient of friction between the side panels or top panel and such traditional cushion-supporting surfaces.

2. The combination of claim 1 including a closable pocket formed on the outside of one of the side panels.

3. The combination of claim 2 when the pocket includes a short panel atttached to the outside of said side panel and stitched thereto along the bottom and side edges with a free top edge, and cooperating fastener means positioned on the said side panel and the top edge of the short panel to close the top of said pocket.

4. The combination of claim 3 wherein the fastener means is Velcro fastening material.

5. The combination of claim 1 wherein the side panel and the bottom panel are disconnected at the corners and the corners of the bottom panel are removed to allow access to the corners of the cellular cushion.

6. The combination of claim 1 wherein the bottom panel mesh is coated with polyvinyl chloride.

7. The combination of claim 1 wherein the one side panel sections are joined by a zipper arrangement.

8. A cover for a cushion comprising:

(a) a top panel positionable over the upper side of the cushion and formed from a highly elastic fabric;

(b) a bottom panel positionable under the cushion and covering substantially the entire underside of the cushion, said bottom panel being formed from a high friction mesh, said mesh being flexible and having parallel ribs and thinner connecting segments extended between the ribs;

(c) side panels located between and connected to the top and bottom panels at the peripheral margins of the top and bottom panels, said side panels being formed from a highly flexible but substantially non-elastic fabric, one of the side panels being divided into sections which are normally joined, but may be detached to permit the cover to be removed from or fitted over the cushion; and (d) the coefficient of friction between the mesh of the bottom panel and traditional cushion-supporting surfaces being substantially greater than the coefficient of friction between the side panels or top panel and such traditional cushion-supporting surfaces.

9. The cover of claim 8 including a closable pocket formed on the outside of one of the side panels.

10. The cover of claim 9 when the pocket includes a short panel attached to the outside of said side panel and stitched thereto along the bottom and side edges with a free top edge, and cooperating fastener means positioned on the said side panel and the top edge of the short panel to close the top of said pocket.

11. The cover of claim 10 wherein the fastener means is Velcro fastening material.

12. The cover of claim 8 wherein the side panel and the bottom panel are disconnected at the corners and the corners of the bottom panel are removed to allow access to the corners of the cushion.

13. The cover of claim 8 wherein the bottom panel mesh is coated with polyvinyl chloride.

14. The cover of claim 8 wherein the one side panel sections are joined by a zipper arrangement.

* * * * *